United States Patent [19]

Huh

[11] 4,395,785

[45] Aug. 2, 1983

[54] BEDROOM CABINET

[76] Inventor: Phil-yool Huh, 5-8, Nakamachi 1-Chome, Musashino-shi, Tokyo 180, Japan

[21] Appl. No.: 269,922

[22] PCT Filed: Oct. 17, 1980

[86] PCT No.: PCT/JP80/00252

§ 371 Date: Jun. 2, 1981

§ 102(e) Date: Jun. 2, 1981

[87] PCT Pub. No.: WO81/01165

PCT Pub. Date: Apr. 30, 1981

[30] Foreign Application Priority Data

Oct. 17, 1979 [JP] Japan ..... 54-132916

[51] Int. Cl.[3] ..... A47B 83/00

[52] U.S. Cl. ..... 5/2 R; 5/432; 312/237

[58] Field of Search ..... 5/2 R, 2 B, 431, 432; 312/237

[56] References Cited

U.S. PATENT DOCUMENTS 473,355 4/1892 Sekofsky ..... 5/2 B
842,800 1/1907 Moore et al. ..... 5/2 R
3,514,794 6/1970 Pofferi ..... 5/2 R
3,900,905 8/1975 Johnson et al. ..... 5/2 R
4,129,123 12/1978 Smidak ..... 5/2 R

*Primary Examiner*—Victor N. Sakran
*Attorney, Agent, or Firm*—Jordan and Hamburg

[57] ABSTRACT

A box-shaped bedroom cabinet, which is assembled by six panels, that is, a bottom panel, a ceiling panel, a front panel, a back panel, a left side panel and a right side panel, said panels being each formed from a synthetic resin molded plate having substantially uniform thickness except edge portions in the peripheral edge thereof, said peripheral edge portion having a relatively large thickness, said portion being provided with a complimentary fitting construction which engages the adjacent panel, said front panel being provided with a large window which also serves as an exit of said cabinet, said bottom panel having a mat laid thereon, either of said left and right side panels being provided with an inwardly depressed inclined portion which is useful as a backrest when a user sits on said mat, the other side panel being provided with an outwardly depressed portion formed in such a manner that legs of the user may be placed on said depressed portion when the user is laid on the mat.

1 Claim, 7 Drawing Figures

BEDROOM CABINET

FIELD OF THE INVENTION

The present invention relates to a cabinet for a bedroom, and more specifically, to a unit type bedroom cabinet which is convenient to provide a flophouse facility comprising a number of compartment rooms on the floor of an existing building.

Despite the fact that there are, particularly in cities, a number of persons who desire to temporarily utilize at low charges individual rooms in a flophouse facility requiring no bath room or a flophouse facility for taking a nap, there have been hardly seen hotel owners who provide such flophouse facilities. The reason is that buildings having many small individual rooms are considerably high in building cost and profits obtained for the invested capital are hard to expect. On the other hands, the demand of the above-mentioned flophouse facilities are always high for enterprisers such as railway enterprise having many night workers and public works contractors who employ labors engaging in work for a short period in remote regions. In the past, the enterprisers must bear high building costs or the employees must stay resignedly in unsatisfactory facilities.

SUMMARY OF THE INVENTION

It is therefore an object of the present invention to provide a bedroom cabinet which can be carried and used by merely placing it on the floor of the existing building.

In accordance with the present invention, a plurality of bedroom cabinets are aligned and as the case may be, these cabinets can be further stacked to thereby provide a flophouse facility composed of many individual rooms in extremely readily and inexpensive manner.

The bedroom cabinet in accordance with the present invention is in the form of a box comprising six panels, that is, a bottom panel, a ceiling panel, a front panel, a back panel, a left side panel and a right side panel, the front panel being provided with a realtively large window which also serves as an exit. The bottom panel has a mat placed thereon, and either of left and right side panels is formed with an inwardly protruded projection portion which is useful as a backrest when a user sits on the mat. The other side panel is formed with a recessed depressed portion conversely thereto, and the recessed depressed portion has a bottom which is positioned at a level higher than the surface of the mat so that when the user laid on the mat, his legs can be placed thereon. The back panel has a foldable table board hinged to the back panel mounted thereon. Also, in the vicinity of the table board, there is provided a box used for an interphone or a radio receiver. A room lamp is provided at the upper part of the back panel. Another box for accommodating therein a TV receiver is mounted at the upper part of the other side panel opposed to one side panel having a projected portion which is useful as a backrest. A curtain rail is mounted on the window of the front panel so that the window can be closed by the curtain slidably supported on the rail. The front panel and back panel have mounting portions for a ladder to be used by a user for the upper cabinet when these cabinets are stacked. Said mounting portions has a portion depressed inwardly of the cabinet in order to increase a clearance between each step of the ladder and the panel. The mounting portions for the ladder are provided on both the front and back panels because, where passages are provided on both front and back of the cabinet, the exit of the upper cabinet can be of the back of the lower cabinet and where a passage is provided only on the front of the cabinet, the exit of the upper cabinet be on the same side as the lower cabinet.

DESCRIPTION OF THE PREFERRED EMBODIMENTS

Figure 1:
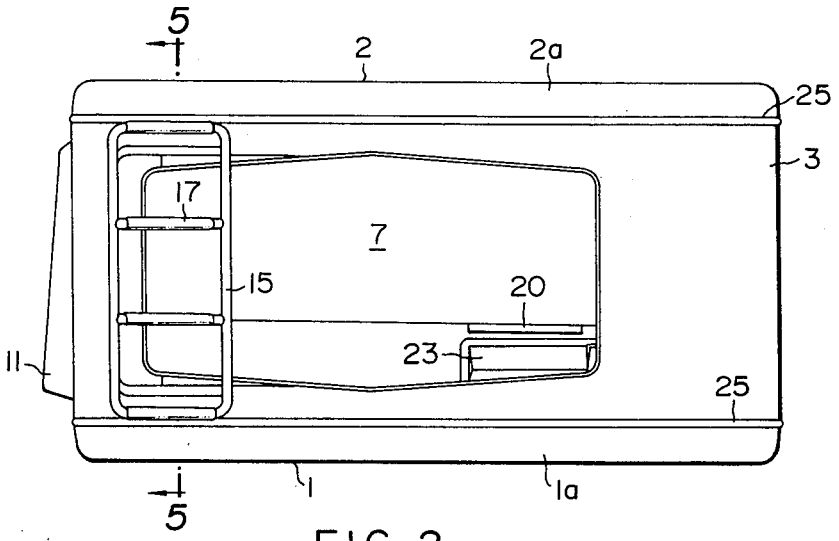
FIG. 1 is a front view of a cabinet for a bedroom in accordance with the present invention.
Figure 5:
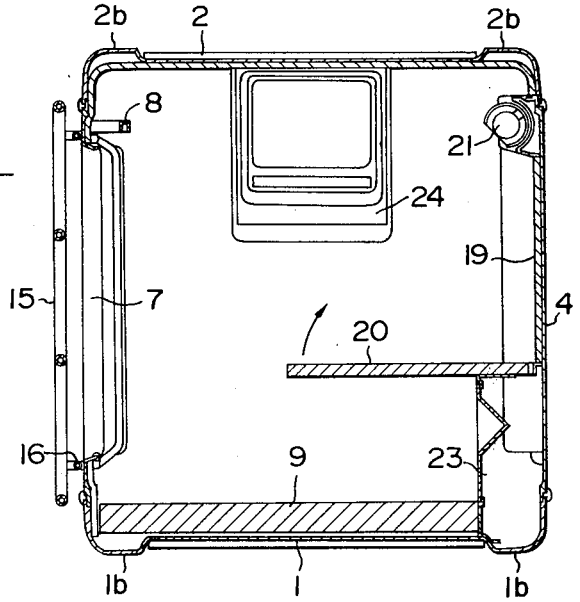
FIG. 5 is a sectional view taken on line 5—5 of FIG. 1.
Figure 6:
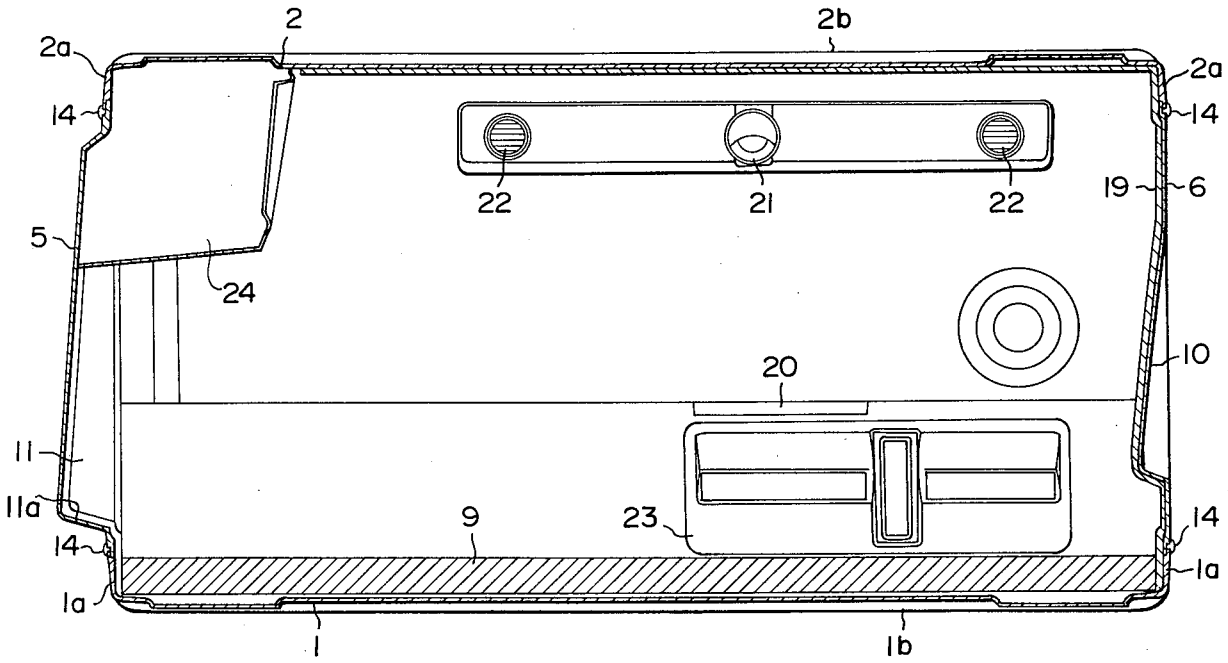
FIG. 6 is a sectional view taken on line 6—6 of FIG. 4.

A cabinet for a bedroom in accordance with the present invention comprises six panels, which are premolded of a hard synthetic resin, these panels including a bottom panel 1, a ceiling panel 2, a front panel 3, a back panel 4, a left-side panel 5 and a right-side panel 6. The bottom panel 1 and the ceiling panel 2 are molded to have exactly the same shape, these panels having peripheral walls 1*a* and 2*a* in the form of a rectangular dish and further having reference portions 1*b* and 2*b* projected in a web-like fashion on both sides in a longitudinal direction thereof, as is apparent from FIG. 5. Open to the front panel 3 (FIG. 1) is a large exit and window 7, and a curtain rail 8 (FIG. 5) is mounted internally of the window 7, said rail 8 having a curtain (not shown) extended thereon. A mat 9 is placed on the bottom panel 1. In the illustrated embodiment, referring to the drawings, particularly to FIG. 6, the right side panel 6 is formed with an inclined portion 10 which is useful as a backrest when a user sits on the mat 9, said portion 10 being formed by depressing a part of the right side panel 6 inwardly. The other left side panel 5 is formed with an outwardly depressed portion 11, and said depressed portion 11 has a bottom 11*a* which is positioned at a level higher than the surface of the mat 9 so that when the user laid on the mat 9, his legs can be placed thereon.

Figure 2:
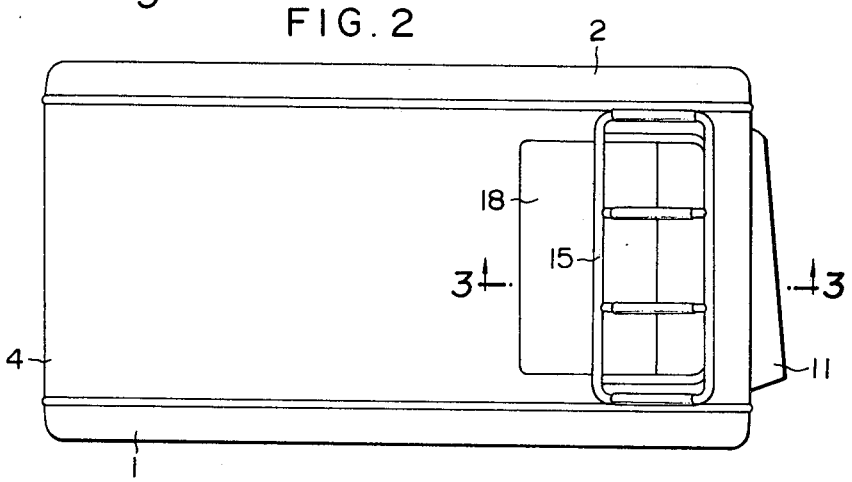
FIG. 2 is a rear view thereof.
Figure 3:
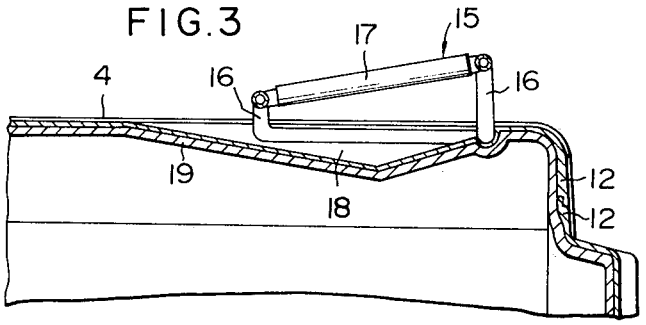
FIG. 3 is a sectional view taken on line 3—3 of FIG. 2.
Figure 4:
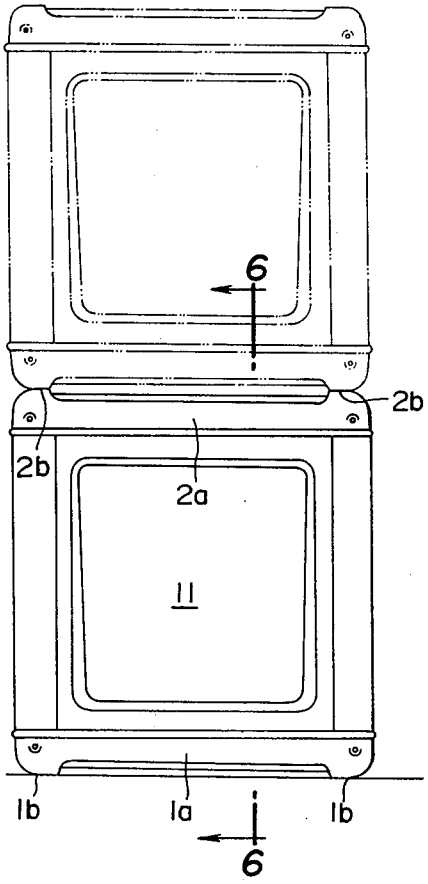
FIG. 4 is a side view showing the cabinets shown in FIG. 1 placed one above another.

Referring now to FIGS. 2 and 3, which show a ladder 15 for the sake of explanation, this ladder 15 is provided to be used by the user of the uppermost cabinet when these cabinets are placed one above another as shown in FIG. 4. It is natural that the ladder 15 need not be provided if the cabinets are not stacked. However, it is preferably designed so that the ladders 15 may be mounted on both front and back of the cabinet for a standard cabinet in order to secure freedom of method for setting cabinets for a bedroom. The ladder 15 has mounting legs 16 at upper and lower ends thereof, the ladder being supported by screwing the legs 16 into the front panel 3 or the back panel 4. In this case, in order to substantially increase a clearance between each step 17 of the ladder 15 and the front panel 3 or rear panel 4, the front panel 3 or back panel 4 is inwardly depressed at its portion 18 so that the ladder 15 may be put up as shown in FIG. 3. This portion 18 is formed so that its cross section is in the form of an open V-shape, and the ladder 15 is fixed substantially parallel to one surface of the V-shape. This can prevent the ladder 15 from greatly protruded from the cabinet and reduce trouble to a walker who passes through along the cabinet.

Figure 7:
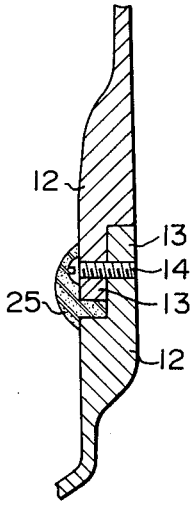
FIG. 7 is an enlarged sectional view showing the connected portions between panels.

Panels 1 to 6 each comprises a molded plate of substantially uniform thickness except edge portions thereof. The edge portion 12 of each panel has a thickness greater than that of other portions to form a complementary fitting construction which engage the panel adjacent to said portion, as is apparent from FIG. 7. Such fitting construction is well known and therefore will not be described in detail. However, in the illustrated embodiment, it comprises a complementary engaging rib 13, said engaging portions being secured to each other by means of screws 14. In this case, between the rib 13 of one panel and the other panel, there is provided a slight clearance into which a joint 25 is mounted. At least those other than the front panel 3 having a large window 7, that is, the bottom panel 1, the ceiling panel 2, the right side panel 6, the left side panel 5 the back panel 4 are formed with depressed portions or protruded portions 1*b*, 2*b*, 10, 11 and 18 by molding, in addition to large wall thickness portions of the edges, and it is therefore important that reinforcement action is exerted on stress applied to the panel to which said portions are related. As a consequence, each panel may be formed of a relatively thin material, and thereby, the cabinets may be manufactured in light-weight and at less cost. Preferably, those other than the bottom panel 1 are internally coated with an ornamental or sound-proof lining 19, and the bottom panel 1 and ceiling panel 2 are bored with a number of vent holes.

Cabinets can be internally equipped selectively with various tools, articles or accessories. In the illustrated embodiment, the back panel 4 has a foldable table board 20 hinged to said panel mounted thereon, and an illuminating lamp 21 is mounted at the upper part of the board 20. A vent or a fan 22 can be mounted on the front panel 3, as desired. In the vicinity of the table board 20, there is provided a box 23 used for an interphone or a radio receiver. On the other hand, a box or a shelf 24 for accommodating therein a TV receiver is mounted on the upper portion of the left side panel 5 opposite the right side panel 6 having the backrest portion 10.

I claim:

1. A box-shaped bedroom cabinet, which is assembled by six panels, that is, a bottom panel, a ceiling panel, a front panel, a back panel, a left side panel and a right side panel, said panels each being formed from a synthetic resin molded plate having substantially uniform thickness except edge portions in the peripheral edge thereof, said peripheral edge portion having a relatively large thickness, said portion being provided with a complimentary fitting construction which engages the adjacent panel, said front panel being provided with a large window which also serves as an exit of said cabinet, said bottom panel having a mat laid thereon, either of said left and right side panels being provided with an inwardly depressed inclined portion which is useful as a backrest when a user sits on said mat, the other side panel being provided with an outwardly depressed portion formed in such a manner that legs of the user may be placed on said depressed portion when the user is laid on the mat.

* * * * *